US008602669B2

(12) United States Patent
Hopkins et al.

(10) Patent No.: US 8,602,669 B2
(45) Date of Patent: Dec. 10, 2013

(54) HYBRID PRINTER-FEEDER MECHANISM

(71) Applicant: The Imaging Systems Group (ISYS), Calgary (CA)

(72) Inventors: Mark Hopkins, Calgary (CA); James Dombeski, Calgary (CA); Bruce Eisentraut, Calgary (CA)

(73) Assignee: The Imaging Systems Group Inc., Calgary (CA)

( * ) Notice: Subject to any disclaimer, the term of this patent is extended or adjusted under 35 U.S.C. 154(b) by 0 days.

(21) Appl. No.: 13/689,513

(22) Filed: Nov. 29, 2012

(65) Prior Publication Data

US 2013/0084120 A1 Apr. 4, 2013

Related U.S. Application Data

(63) Continuation of application No. 12/611,718, filed on Nov. 3, 2009, now abandoned.

(51) Int. Cl.

| | |
|---|---|
| ***B41J 11/46*** | (2006.01) |
| ***B41J 15/04*** | (2006.01) |
| ***B41J 15/16*** | (2006.01) |
| ***B41J 29/38*** | (2006.01) |

(52) U.S. Cl.

USPC ..... 400/613; 400/619; 400/621; 400/633; 400/633.2; 400/618

(58) Field of Classification Search

CPC ..... B41J 11/46

USPC ..... 400/619, 633, 633.2, 613, 621, 618

See application file for complete search history.

(56) References Cited

U.S. PATENT DOCUMENTS

| | | | | | |
|---|---|---|---|---|---|
| 5,375,494 | A | * | 12/1994 | Kajita et al. | 83/210 |
| 5,502,477 | A | * | 3/1996 | Osada et al. | 347/176 |
| 5,708,345 | A | * | 1/1998 | Kramer et al. | 318/696 |
| 6,039,479 | A | * | 3/2000 | Hill et al. | 400/621 |
| 2002/0197091 | A1 | * | 12/2002 | Otsuki | 400/582 |
| 2004/0156665 | A1 | * | 8/2004 | Ng et al. | 400/578 |
| 2008/0003039 | A1 | * | 1/2008 | Sekino et al. | 400/188 |
| 2009/0016785 | A1 | * | 1/2009 | Haan et al. | 399/301 |
| 2009/0016797 | A1 | * | 1/2009 | Brugue et al. | 400/613 |

FOREIGN PATENT DOCUMENTS

| | | | | | |
|---|---|---|---|---|---|
| JP | 58215380 | A | * | 12/1983 | B41J 15/00 |
| JP | 05097125 | A | * | 4/1993 | B65B 41/16 |
| JP | 06048628 | A | * | 2/1994 | B65H 23/185 |
| JP | 06278938 | A | * | 10/1994 | B65H 43/08 |
| JP | 2002361939 | A | * | 12/2002 | B41J 3/54 |
| JP | 2008063079 | A | * | 3/2008 | |

* cited by examiner

*Primary Examiner* — Daniel J Colilla

(57) ABSTRACT

Hybrid printer feeder mechanism, using a commercial printer of any type, such as LED, ink jet, thermal or dot matrix, allowing both single sheet fed input and alternately, continuous and variable width printable medium feedstock, including automated feed and cutting control, with minimal integration of the print engine and feeder.

9 Claims, 7 Drawing Sheets

HYBRID PRINTER-FEEDER MECHANISM

FIELD

The present invention relates to a hybrid printer-feeder mechanism, using a commercial printer or print engine of any type, such as an LED, ink jet, thermal or dot matrix print engine, allowing both single sheet media input feed and alternately, continuous and variable width media feedstock, such as printable medium feedstock, including automated feed and cutting control, with minimal integration of the print engine and feeder.

BACKGROUND

Traditional web feed printing processes have used a series of expensive mechanical rollers and counterbalancing components to assist in controlling movement of printable medium through printing units. Mechanical systems experience wear and require ongoing monitoring and regular maintenance. It is desirable to have sensor and microcontroller operation instead. Further, the control model should be generalized. A control model, for alternating between single sheet printable medium and continuous printable medium, is seen in U.S. Pat. No. 5,214,750. It defines modes of operation and the flow control of motors. That control system is application specific, not generalized.

In the industry today, products aimed at label printing are identified as dedicated printers. They generally use web printing processes, continuous roll printable medium feedstock, and have been designed specifically for label printing. Label printing occurs in two stages, with the first pass for logos and background material. A second stage is used to print job specific data like prices, SKUs (stock keycodes), barcodes or promotional materials. Likewise, point of sale printers are recognized as dedicated devices, aimed at printing receipts and records of transactions.

Dedicated printers may be larger laser printers or smaller point of sale thermal or ink jet printers, as disclosed in U.S. Pat. Nos. 6,474,883 and 6,343,884, respectively. In both cases, the degree of integration between the print engine and the printable medium feed mechanisms is very high. A print engine generally has printer heads and conveying mechanisms to move printable medium or other print media. The print engine and its continuous printable medium feeder mechanism cannot be decoupled in these two cases. The feeder mechanisms do not have independent operating capabilities, suited to readily adapt to an entirely different print engine.

One instance of a feeder that is somewhat separate from a print engine is seen in U.S. Pat. No. 7,165,741. In this case an external cartridge is attached to the body of a print engine and efforts are made to position printable medium and control rattling of printable medium. The printable medium positioning is manual and, therefore, prone to error or possible damage of the media end. Rattling of printable medium may be better controlled through appropriate tensioning of printable medium and some minimal guidance.

To summarize, some of the shortcomings of existing technology include the use of mechanical web guides or single purpose control mechanisms, rather than generalized control systems. Another shortcoming is the tight coupling between print engines and feeder mechanisms which does not allow easy adaptation of the feeder mechanism to an entirely different print engine. More independent print media cartridges have manual printable medium or media positioning, which is prone to inaccuracy.

SUMMARY OF THE INVENTION

According to the invention there is provided a hybrid printer-feeder, comprising a printable medium source dispenser for supporting and dispensing printable medium at a start of a printable medium path. A printable medium extraction roller assembly is positioned to receive printable medium from the printable medium source dispenser and minimize printable medium skew. Position sensors located proximate printable medium exiting from the printable medium extraction roller assembly measure a distance traveled by the printable medium along the printable medium path. Printable medium feed rollers positioned after the position sensors drive the printable medium along the printable medium path. An end-of-job cutter is operative to cut continuous roll printable medium at an end of a print job. A microcontroller mounted in the printer-feeder and coupled to each of a printable medium, a printable medium extraction roller assembly, position sensors, printable medium feed rollers and end-of-job cutters, is operative to control all printer feeder functions and provide logical coupling between a print engine and the printer-feeder.

The current invention is aimed at generalized hybrid printer and feeder mechanisms. The invention is aimed at creating a hybrid product, comprised of a low cost standard commercial printer designed for single sheet input feed, combined with a uniquely designed, variable width, continuous printable medium feeder mechanism. The current invention includes requisite control components, for tag or label printing, or receipt printing, or other generalized printing jobs. The commercial printer unit may be of any type, for example, black and white or color CMYK light emitting diode (LED) based printers, color inkjet printers, dot matrix printers or various thermal printers. There are no physical limitations on printer types. The commercial printer unit is also called a print engine.

The printable medium source dispenser includes printable medium selected from the group consisting of a roll of continuous printable medium, single sheet printable medium, and fan-fold printable medium.

A printable medium extraction roller assembly includes a tensioning roller to apply pre-selected tension to the printable medium.

A pair of opposed printable medium guides moveable toward each other or away from each other to a position in which they allow movement of the printable medium therethrough and guide at least one edge of said printable medium as it moves.

A printable medium extraction roller assembly extracts printable medium from the printable medium source and forces the printable medium to align with one of the printable medium guides.

The printable medium extraction roller assembly includes a skew roller to align said printable medium with one side of a media centering rack.

The printable medium extraction roller assembly includes a positioning encoder operative to convert analog printable medium location into a digital signal which is interrogated by the microcontroller.

The printable medium feed rollers include a feed drive roller and a pinch roller engaging the printable medium and driving it along the printable medium path.

The printable medium is a continuous roll printable medium mounted on a spindle. The microcontroller speeds up the feed drive roller at an end of a print job so as to create slack in the printable medium at an end-of-job cutter and the cutter then cuts the printable medium.

The feed drive roller is driven by a unidirectional clutch drive coupled by a belt to a drive motor.

The printable medium source dispenser is a spindle which supports a supply roll of printable medium, and is coupled to a spindle motor which drives the spindle in rotation.

The feeder mechanism is mounted inside a tray that fits below the print engine and couples to the latter by an interface connector.

A tensioning roller receives printable medium from the roll of printable medium on the spindle and a sag sensor, positioned proximate the printable medium between the tensioning roller and the spindle, is operative to measure sag of the printable medium.

A printable medium guide is positioned on both sides of the printable medium path operative to guide both edges of the printable medium.

A drive motor coupled through a unidirectional clutch drive to a feed drive roller which pinches the printable medium between itself and a pinch roller creating enough pressure to advance the printable medium upwards to a print engine.

Positioning sensors located proximate an edge of the printable medium and operative to measure a distance that the printable medium travels along the printable medium path.

Each guide has an attached centering rack which is coupled to a spur gear. The spur gear pulls the guides inwardly upon rotation in one direction and pushes them outwardly upon rotation in another direction.

A sag detector positioned near the printable medium source is operative to detect an amount of droop of the printable medium in the printable medium path.

The position sensors include a slotted sensor which detects a notch in the printable medium and a reflective sensor which detects a black rectangle on one side of the printable medium at a top of a label, tag or page.

The printable medium is in a printable medium roll mounted on a spindle or a fanfold printable medium.

The printable medium can be paper or film or any other printable medium.

In another aspect of the invention there is provided a method for feeding printable medium to a printer, which includes the following steps:

(a) storing printable medium in a printable medium source and dispenser;
(b) extracting printable medium from said printable medium source;
(c) tensioning the extracted printable medium;
(d) guiding the printable medium to travel along a printable medium path adjacent to a guide;
(e) measuring position of said printable medium along the printable medium path; and
(f) feeding the printable medium to a print engine.

The printable medium is extracted from the printable medium source with a feed roller mounted on a one-way clutch and engaging a pinch roller and a drive motor driving the one-way clutch.

The tension in the printable medium is measured by detecting droop in the printable medium in said printable medium path.

The printable medium feeder or medium feeder mechanism disclosed herein handles any type of continuous media, which typically will be roll feed printable medium or fan-fold (Z-fold) printable medium, or waxed printable medium backing and adhesive label rolls, or thermal printable medium or any other continuous print media. The printable medium may range from a few inches wide to more than a foot wide. The feeder mechanism has sensors and motors for control of printable medium or medium movement. A microcontroller unit is attached to the feeder to provide process control for the feeder and simple logical coupling between the standard commercial print engine and the printable medium feeder mechanism. The sensor and microcontroller approach taken by the current invention overcomes limitations in existing technology in several ways, including replacement of web rollers for printable medium tensioning, enabling of programmable control algorithms and automated printable medium positioning.

The microcontroller or process controller ensures that feeder performance specifications are met, such as minimal printable medium skew, location of printing on labels, and cutting labels at correct points. Sensor data from the feeder, and status data from the print engine, are used by controller algorithms to control printable medium feed motors and any other actuators in the system. The print engine handles parameters internal to the printing process, such as precise four color registration.

In addition to the end-to-end system movement of printable medium, control of print content is included in the concept of the current invention. For example, a software application is used to determine the specific image to be transferred to any single label or at any line along the path of a continuous printing process, like well-logging. In order to create a stand-alone printer product, a touch screen, or alternative integrated user interface, is used to load and manage image applications software. The current invention may also be attached to a network, or managed by a local laptop or computing device, in order to integrate printing applications software with the system.

BRIEF DESCRIPTION OF THE DRAWINGS

Further features and advantages will be apparent from the following detailed description, given by way of example, of a preferred embodiment taken in conjunction with the accompanying drawings, wherein.

DESCRIPTION OF THE PREFERRED EMBODIMENTS

One preferred embodiment involves implementation of a CMYK printer and feeder combination. The printer-feeder must accommodate high performance printing parameters. Printable medium movement is high speed, at 3 to 6 inches per second or around 10 cm per second. Input media may have tension in ranges like 0-15 lb-in, and tension requirements varying according to the print engine. The term "printable medium" herein refers to any sheet material on which printing may be effected such as paper, mylar film, photographic film, plastics, labels with or without adhesives, dye cut labels and fabric in either roll or fanfold format. Media skew, which is the slant of lines of print, should be held below a visible defect level, for proper printing alignment. Another object of printing is to minimize loss due to printable medium cutting at the end of a job.

Initial Medium Path

Figure 1:
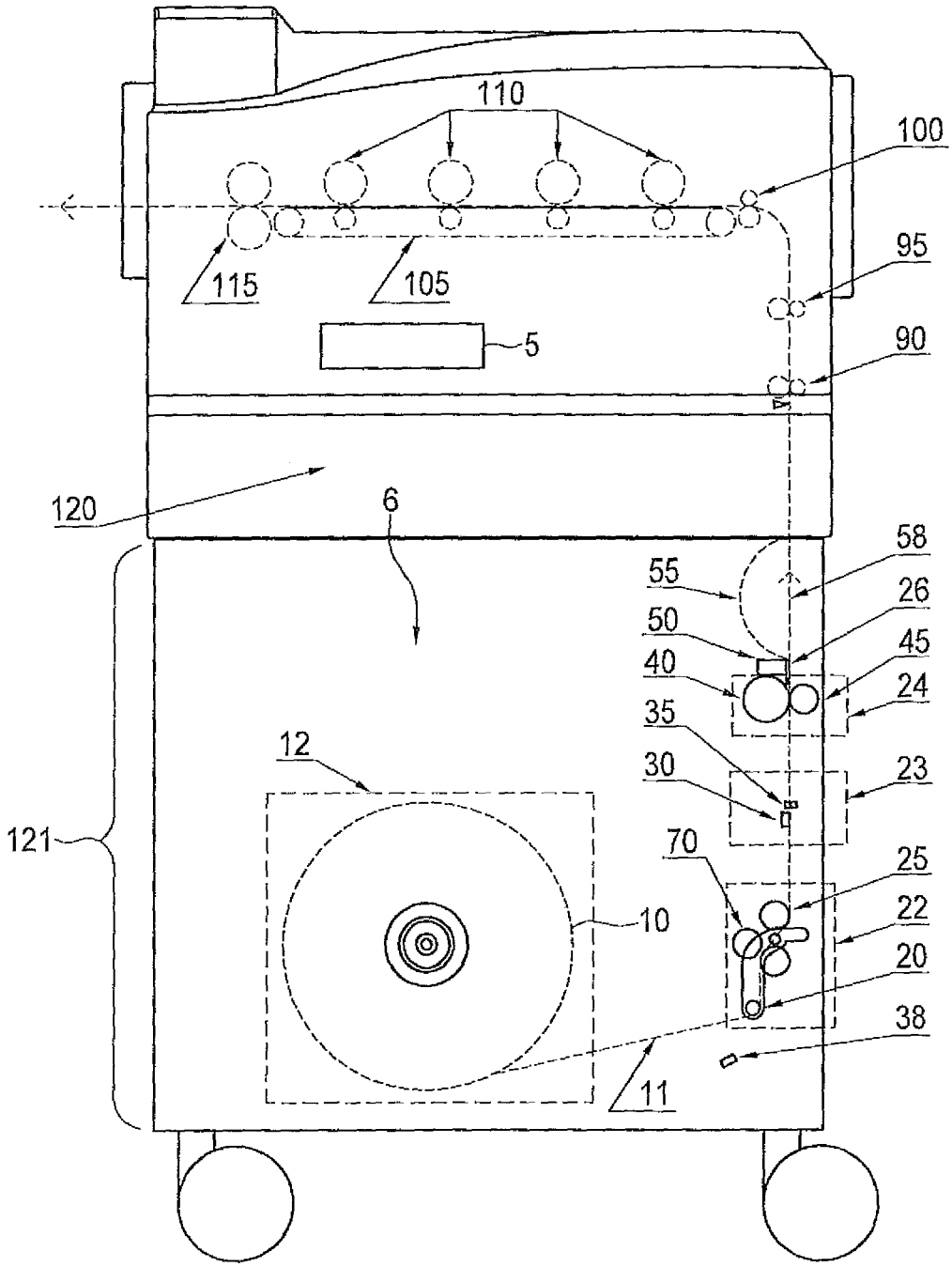
FIG. 1 is a left side view of the interior of the print engine and feeder mechanism, showing the media path and sensors along the media path, with a printable medium supply roll.

Referring to FIG. 1, a left side view of the system, there is a print engine 5, which is a commercial printer unit, designed for single sheet printable medium feed, via upper tray 120. An alternate feeder mechanism 6, for continuous and variable width medium 11, is incorporated in the region of lower tray 121. The printable medium supply roll 10 is commonly a printable medium roll of variable width and is mounted on a printable medium source dispenser 12 in the feeder mechanism 6. There is a tensioning roller 20, which is a passive device that moves on a pivot, to assist in maintaining tension in the printable medium 11. A sag sensor 38 measures droop in the printable medium path 56, as the printable medium 11 exits from the supply roll 10. The sag sensor 38 is an analog reflective distance measuring sensor. The latter sensor uses triangulation to measure distance of a reflective object on the printable medium by processing the optical spot position electronically.

A paper extraction roller assembly 22 includes the tensioning roller 20 as well as a skew roller 25. The skew roller 25 is used to force the media to align with one side of a media centering rack 60 shown on FIG. 3. The medium centering rack 60 angles the printable medium toward one of a spaced apart pair of guides 65. If a constant angle offset is not sufficient to control printable medium skew, then the skew roller 25 may have its angle adjusted dynamically, as determined by a microcontroller 135 shown in FIG. 2.

There are two positioning sensors 23, reflective sensor 30 and slotted sensor 35, to measure the distance that the printable medium 11 has traveled along the medium path. These sensors operate independently. A slotted sensor 35 detects a notch in the media. A reflective sensor 30 is used to detect a black rectangle on one side of the media, at the top of a label, a tag or a page. A second reflective sensor 32 may be positioned on the opposite side of the printable medium 11. A positioning encoder 70, is placed where convenient, and converts analog printable medium location into a digital signal, to send to the microcontroller 135.

Controller Functions and Modes of Operation

Figure 2:
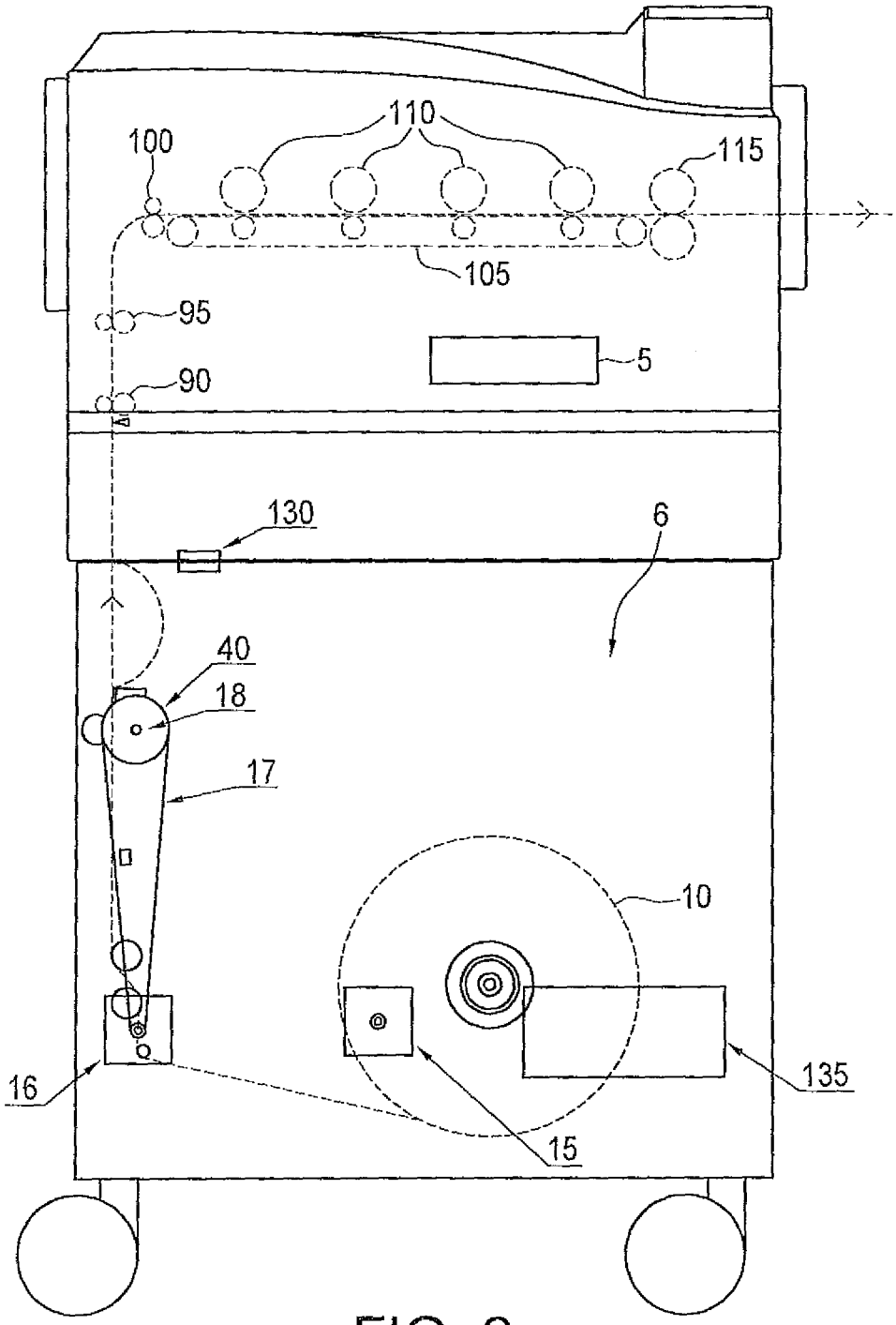
FIG. 2 is a right side view of the interior of the printer engine and feeder mechanism, showing the microcontroller, drive motor and spindle motor mechanisms.

Control of all of the operations of the feeder mechanism 6 is handled in a microcontroller 135, shown in FIG. 2. It is sufficient to use a low cost microcontroller in this embodiment, with a processing capacity of 10 MIPS, 8-bits, programmed in Assembler programming language. There are calibration algorithms for changing media parameters, such as the weight of printable medium. With added expense, the microcontroller 135 capabilities described here may be expanded significantly, as may be required for an alternate embodiment.

FIG. 2. shows a right side view of the system. When the lower tray 121 slides into place, contact is made at an interface connector 130. The interface connector 130 signals both the print engine 6 and the microcontroller 135 that the lower tray 121 is in place and that, after an appropriate settling time interval, printing may begin. The microcontroller 135 also receives 'start-of-job' and 'end-of-job' status from the print engine 5. As described next, the microcontroller 135 sets the correct modes of operation for the feeder mechanism 6.

Three modes of operation are identified first, then described in more detail. At the start of the job, the feeder mechanism 6 must drive the medium 11 into the print engine 5. Paper feed rollers 24 contain a feed drive roller 40 that engages the printable medium between the feed drive roller 40 and a pinch roller 45 which grips the printable medium. The feed drive roller 40 is coupled by a belt to drive motor 16 and, when driven by a drive motor 16, pulls the printable medium off of the printable medium source dispenser 12 and delivers it to the print engine 5. During active printing, the drive motor 16 is idle and the feeder mechanism 6 must maintain a nominal tension on the medium 11 as the print engine continues to extract paper from the printable medium source dispenser 12. At the end of a print job, the feed drive motor 16 operates at a high speed so that the feed drive roller 40 causes slack in the printable medium 11 to allow cutting independently of whether or not printing is taking place. All three modes of operation are now described in more detail.

Referring to both FIGS. 1 and 2, for the start-up mode of operation, a feed drive motor 16 is engaged and causes a drive belt 17 to turn the feed drive roller 40. The feed drive roller 40 pinches the printable medium 11 between itself and a pinch roller 45, creating the pressure needed to advance the medium 11 upwards to the print engine 5, where it enters a first set of pinch rollers 90 in the printer. These are also called the first registration rollers 90.

During an active print run, the feed drive motor 16 is idle, and a unidirectional clutch drive 18, prevents any action by the feed drive roller 40, so there is no forward or backward tension on the medium 11 from the drive motor 40 assembly. The spindle motor 15 is engaged to turn the supply roll 10, which may be very heavy, thereby maintaining appropriate medium tension, through the sag sensor 38 and tensioning roller 20, as supervised by the microcontroller 135.

Toward the end of a print run, the medium 11 must continue to travel through the print engine 5, while medium cutting takes place. The spindle motor 15 and the feed drive motor 16 operate at a higher speed, so that the feed drive roller 40, causes medium slack 55, outside the normal medium path 56. This allows application of the medium cutter 50, without disturbing the printable medium 11, as it completes its pass through the print engine 5. The medium cutter 50 is full width and is typically a guillotine cutter.

Figure 3:
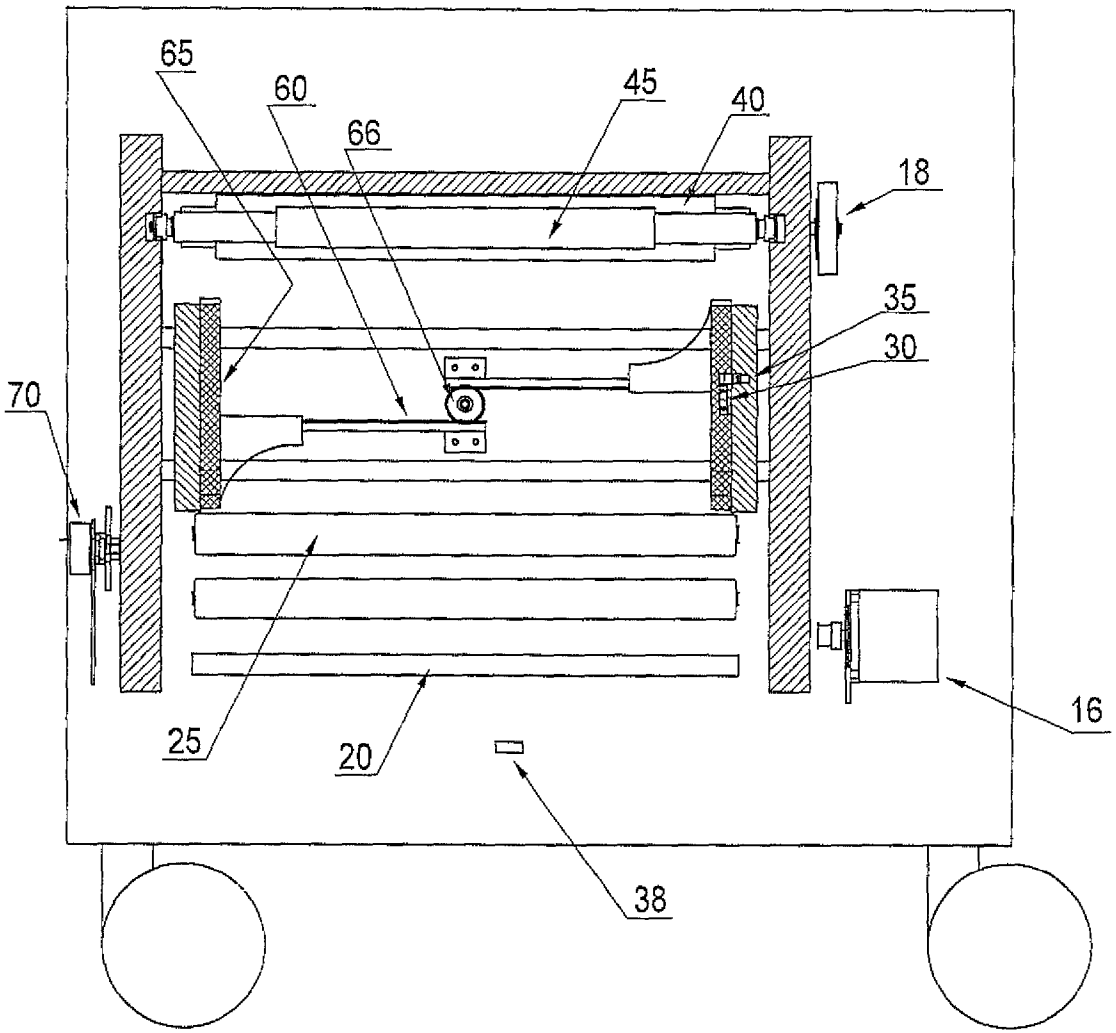
FIG. 3 is a backend view of the feeder mechanism, showing the media centering rack and guides.

The microcontroller 135 also uses data from the reflective sensor 30 and the slotted sensor 35, see FIG. 3, as part of its control of mode of operations, and as feedback to the print engine 5, and as input to imaging application software, which requires precise positioning data for accurate image location on the print medium 11.

Inside the Print Engine 5

Referring to FIG. 1, when the medium 11 exits the feeder mechanism 5, it passes through three sets of pinch rollers 90, 95, 100 and is guided to the printing surface or transfer belt 105. The first and third pinch rollers 90, 100, respectively, are also called registration rollers and these control the precise speed of movement of medium 11 along the transfer belt 105 and under four color image drums 110. These drums use a four colour cyan, magenta, yellow and black or CMYK standard. The print engine 5 is a LED based technology, using light emitting diodes. Images are imprinted by four color LEDs, not shown, on four light sensitive drums 110. The drums 110 roll over toner, not shown, which is picked up by the drum in proportion to light intensity. A transfer belt 105 applies toner to printable medium 11. Toner is fixed in a heater or fuser 115 section. The print engine 5 has internal sensors, algorithms, and control mechanisms to ensure precise four color registration in spite of the wide separation of the four color image drums 110. That registration control is a function of the print engine 5 and is not part of the current invention.

Also outside the scope of the current invention, is the use of single sheet printable medium, which emerges from tray 120 and enters the third set of pinch rollers 100 in the print engine 5. In this manner it is possible for a user to select single sheet printable medium input from tray 120, or continuous media input from tray 121.

Media Centering

The hybrid printer feeder can adjust to a wide range of media widths, as seen in FIG. 3, which shows that most rollers 20, 25, 40 cover the full width of the feeder mechanism 6. When a narrower medium is mounted in tray 121 the guides 65 of the medium centering rack 60 can be adjusted manually. The spur gear 66 within the rack 60 pulls the guides 65 equidistant inward to reach both edges of the media 11. Alternately, the medium 11 width may be input to the microcontroller 135, which would use a motor (not shown) to move the spur gear 66 and the media guides 65. No sensors are required to determine media width. This view also illustrates that the slotted sensor 35 and reflective sensor 30 are mounted on the guide 65, so that they are able to scan the edge of the medium 11.

Figure 4:
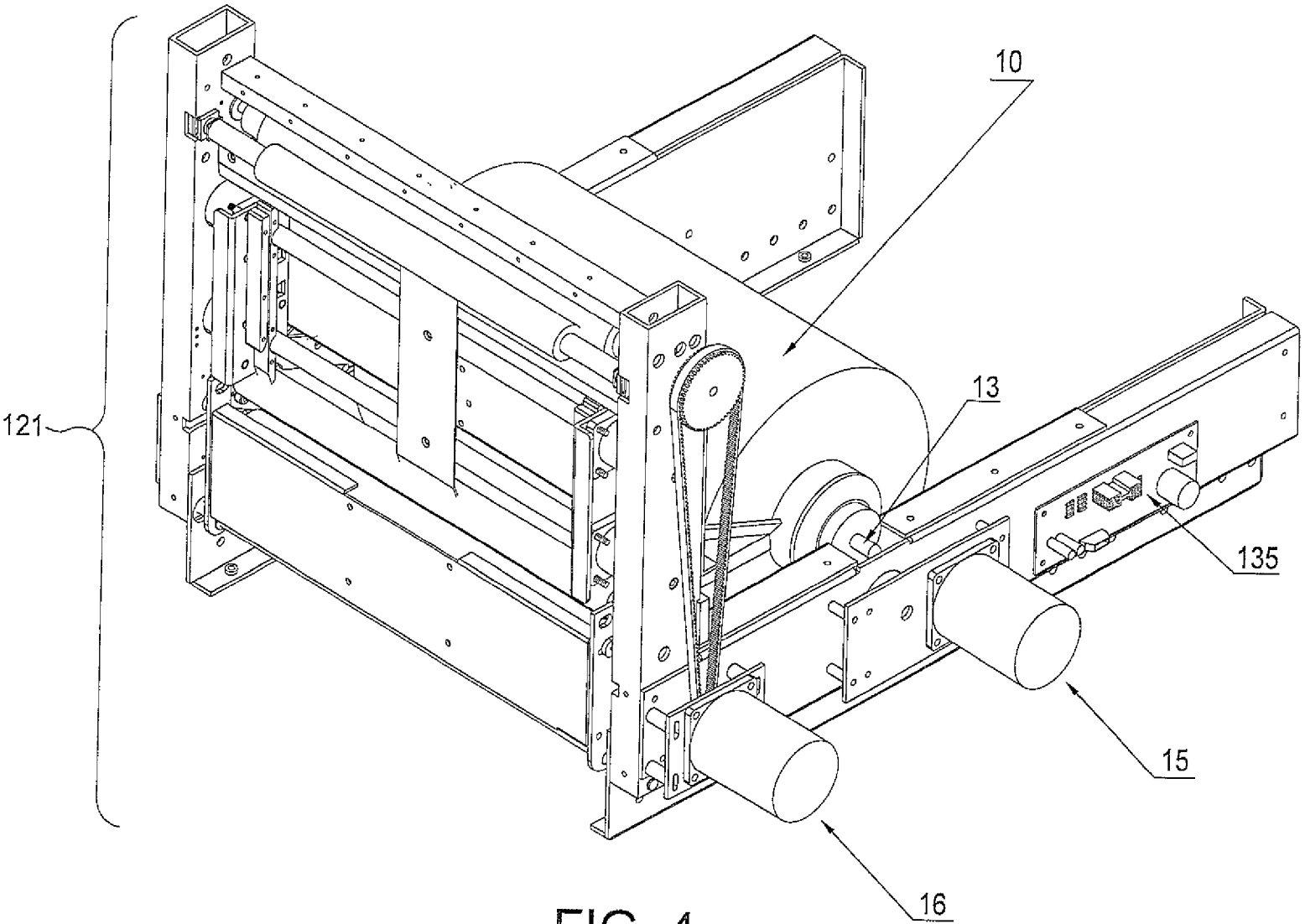
FIG. 4 is a three-dimensional view of the removable components of the feeder mechanism, called tray, with a roll printable medium mounted in place.
Figure 6:
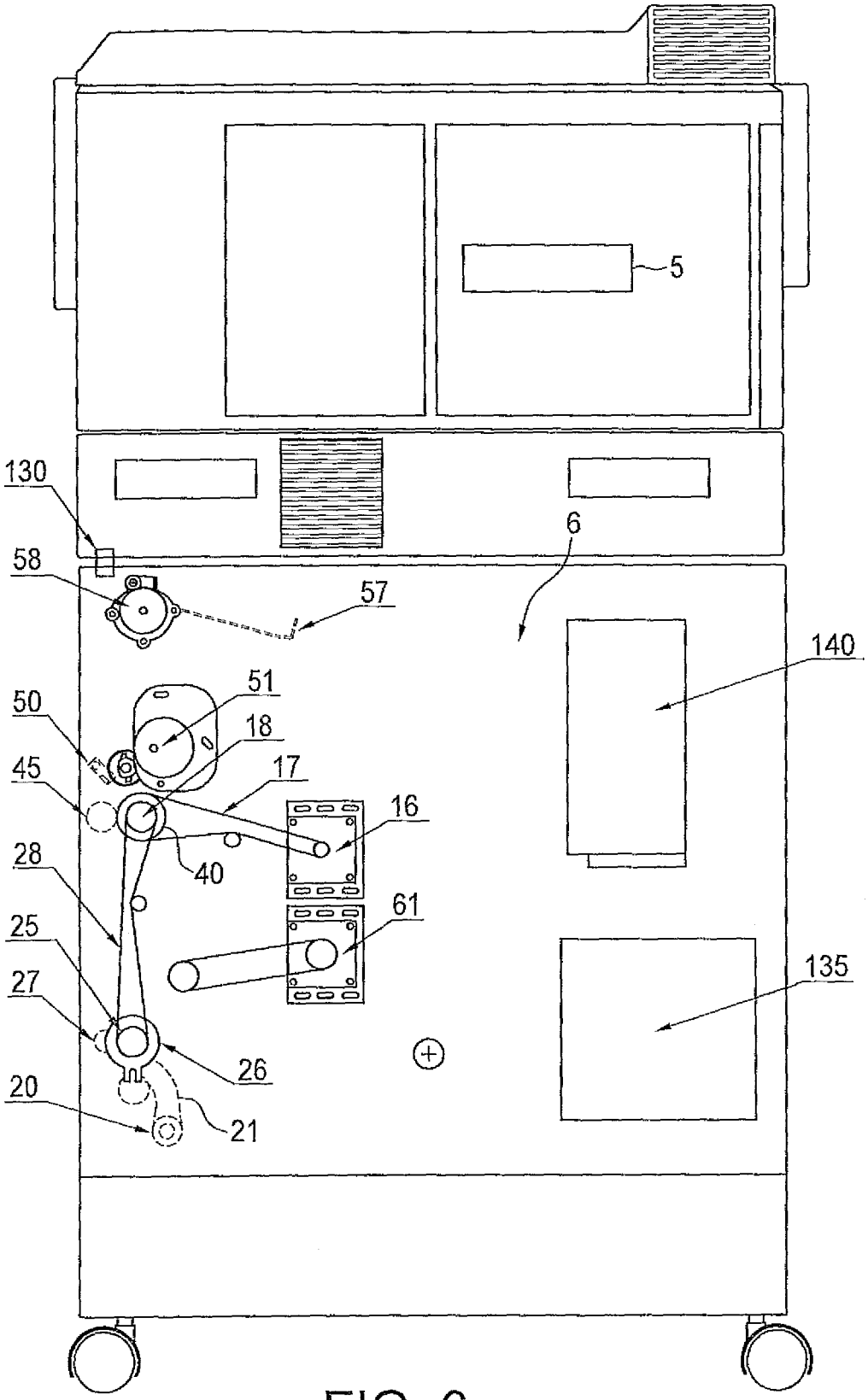
FIG. 6 is a right side view of the interior of an alternate embodiment of the feeder mechanism, where electronics and motors are mounted on the printer-feeder chassis, rather than on the lower tray, thereby improving reliability.
Figure 7:
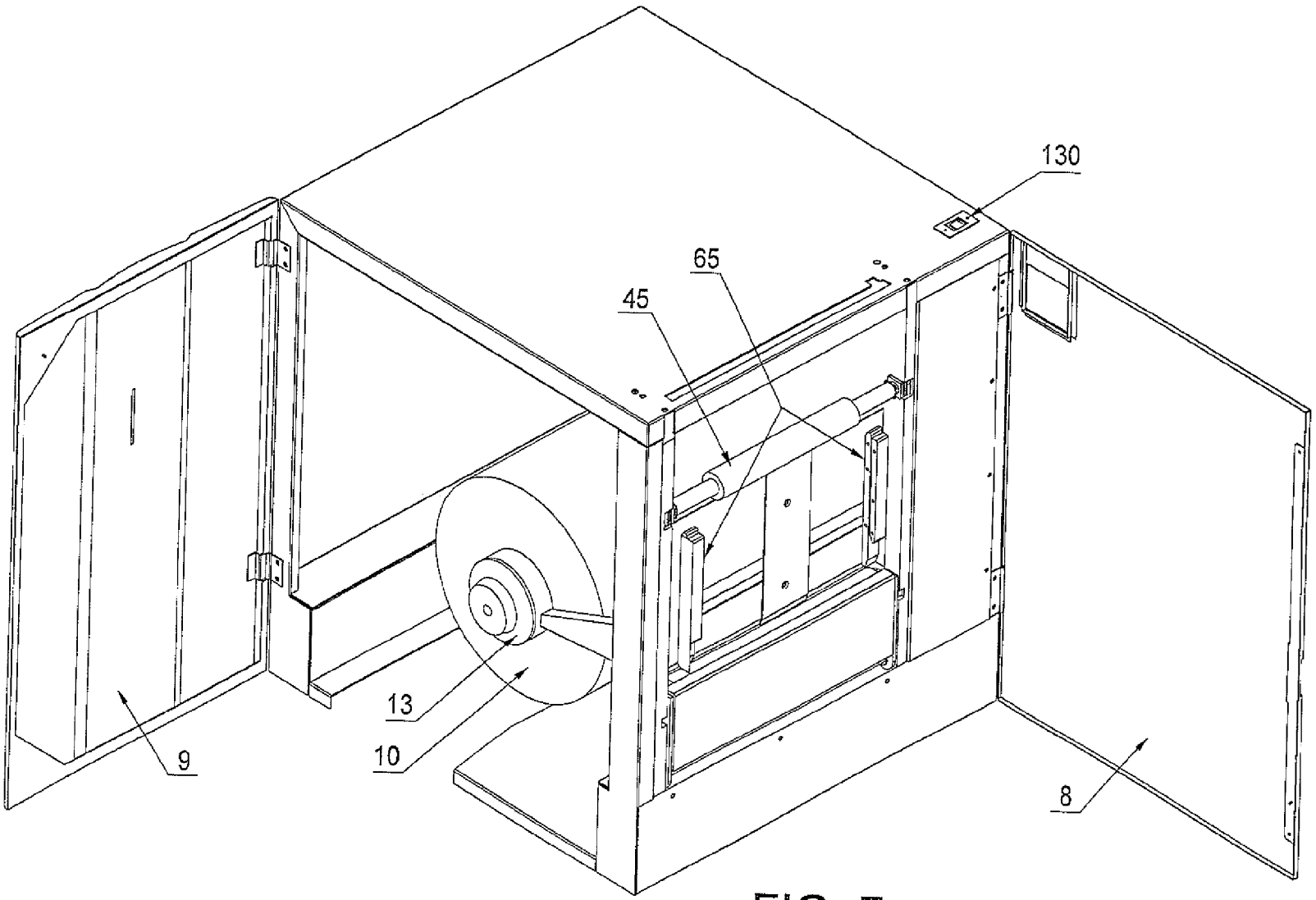
FIG. 7 is a three dimensional view of an alternate embodiment of the feeder mechanism, where the media source is mounted through a door, rather than on the lower tray.

FIG. 4 offers a three-dimensional view of the removable components of the feeder mechanism, called tray 121, with roll printable medium 10 mounted in place. The mounting of the microcontroller 135 board, the spindle motor 15, and the drive motor 16 on the side of tray 121, are also illustrated. While one embodiment has motors 15, 16 attached to tray 121, this is not necessary. Motors 15, 16 and the microcontroller 135 may be mounted directly in the chassis of the feeder mechanism 6 as shown in FIG. 6 and described below. Likewise, the supply roll 10 may be accessed and mounted by alternate means, as shown in FIG. 7.

Figure 5:
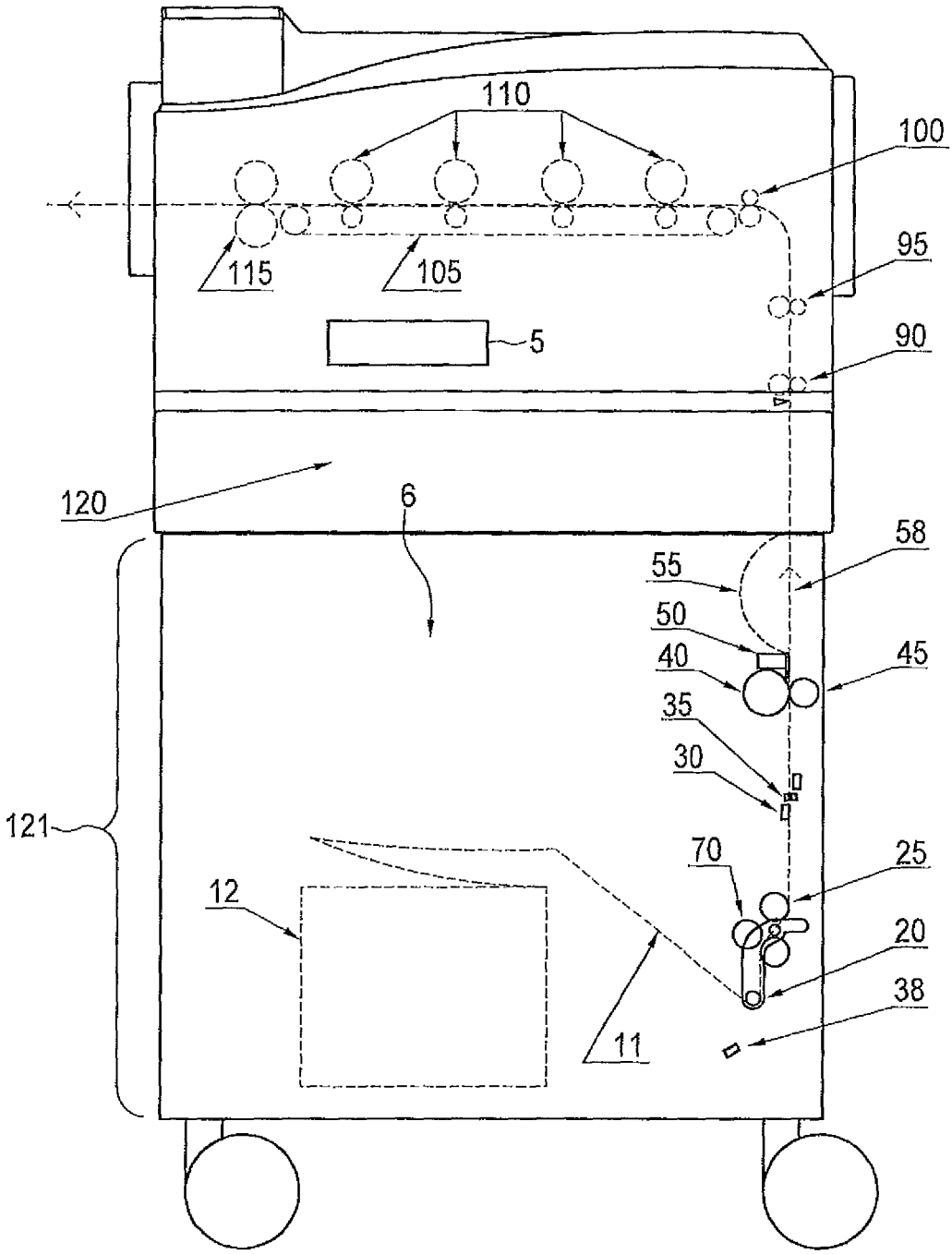
FIG. 5 is a left side view, similar to FIG. 1, with a fanfold or Z-fold printable medium supply.

FIG. 5 shows a left side view of the print engine 5 and feeder mechanism 6, similar to FIG. 1, but with the substitution of a fanfold or Z-fold printable medium supply 12, for the continuous print medium 11. Pinch rollers (not shown) are used for fanfold media handling.

FIG. 6 is a right side view of an alternate embodiment of the feeder mechanism 6, wherein the electronics and motors are mounted directly on the chassis, rather than on tray 121. In this embodiment a separate spindle motor 15 is not required. The supply roll is on a spindle 13, (see FIG. 7), which has bearings and allows easy movement. In this case, a pinch load roller 27 clamps the printable medium 11 against the skew roller 25 during the feed mode of operation. The tensioning roller 20 is mounted on a passive pivot 21 and the weight of the tensioning roller 20 assists in managing paper sag. The drive motor 16 uses a drive belt 17 to drive the feed drive roller 40 at high speed toward the end of a print run, causing medium slack 55 (see FIG. 1) During an active print run, the feed drive motor 16 is idle and a unidirectional clutch 18 prevents action by the feed drive roller 40. A second drive belt, the load drive belt 28, connects the unidirectional clutch drive 18 with the skew roller 25. An electromagnetic clutch 26 operates on the skew roller 25 to engage, so that the printable medium 11 is advanced at the start of a print run.

FIG. 6 also shows one embodiment of the media cutter 50 wherein a cutter gear motor 51 is used to cause the media cutter 50 to cut the printable medium 11. In order to protect users from harm during operation, there is a swing 57, which is closed during active cutting. During an active print run, a swing gear motor 58 is used to keep the swing 57 off of the printable medium.

FIG. 6 shows a media centering rack drive motor 61, which acts on the spur gear 66 of FIG. 3. When loading a printable medium 11 of a new width, the media guides 65 are adjusted by means of the media centering rack 60 and the spur gear 66.

All of the motors 16, 51, 57 and 61, and clutches 18 and 26, are controlled by the microcontroller 135. All electronics and motors are powered by the power supply 140. Communication between the microcontroller 135 and the print engine 5 is allowed by the interface connector 130, which connects the feeder mechanism 6 to the print engine 5.

In FIG. 7, an alternate means of loading the media supply roll 10 is shown. Tray 121 of FIG. 3 is eliminated. A side door 9 opens and the media supply roll 10 simply slides onto the spindle 13. A front door 8 allows access to the media guides 65, pinch roller 45 and other components as needed. There are advantages to removal of tray 121, which is heavy and may be prone to damage.

Mounting the paper feed system directly on the back of the printer chassis places the components at a more convenient height for servicing, and provides a much more compact unit.

It will be obvious to those skilled in the art that there are many alternate embodiments of a hybrid printer feeder able to handle variable width medium, through the use of a microcontroller, sensors, rollers, guides and motors, for detection and controlled movement of medium position and tension, with only loose coupling between the feeder mechanism and print engine.

Accordingly while this invention has been described with reference to illustrative embodiments, this description is not intended to be construed in a limiting sense. Various modifications of the illustrative embodiment will be apparent to those skilled in the art upon reference to this description. It is therefore contemplated that appended claims will cover any such modifications or embodiments as fall within the scope of the invention.

I claim:

1. A hybrid printer-feeder, comprising:

(a) a printable medium source dispenser for supporting and dispensing printable medium at a start of a printable medium path;

(b) a printable medium extraction roller assembly positioned to receive printable medium from said printable medium source dispenser and minimize printable medium skew;

(c) position sensors located proximate printable medium exiting from said printable medium extraction roller assembly and operative to measure a distance traveled by said printable medium along said printable medium path, wherein said position sensors include a slotted sensor which detects a notch in the printable medium and a reflective sensor which detects a black rectangle on one side of the printable medium at a top of a label or tag;

(d) printable medium feed rollers positioned after said position sensors and operative to drive said printable medium along said printable medium path;

(e) a cutter operative to cut continuous roll and fan-fold printable medium; and (f) a microcontroller mounted in said printer-feeder and coupled to each of elements (a) to (e) and operative to control all printer feeder functions and provide logical coupling between a print engine and the printer-feeder; wherein said microcontroller uses data from the reflective sensor and the slotted sensor as feedback to the print engine to precisely position data for accurate image location on the label or tag.

2. The printer-feeder according to claim 1, wherein said printable medium extraction roller assembly includes a tensioning roller to apply pre-selected tension to said printable medium.

3. The printer-feeder according to claim 1, including a pair of opposed printable medium guides moveable toward each other or away from each other to a position in which they allow movement of the printable medium therethrough and guide at least one edge of said printable medium as it moves.

4. The printer-feeder according to claim 3, said printable medium extraction roller assembly forces the printable medium to align with one of said printable medium guides.

5. The printer-feeder according to claim 1, wherein said printable medium feed rollers include a feed drive roller and a pinch roller engaging said printable medium and driving it along said printable medium path.

6. The printer-feeder according to claim 5, wherein said microcontroller speeds up said feed drive roller at an appropriate time so as to create slack in said printable medium at said cutter and said cutter then cuts said printable medium.

7. The printer-feeder according to claim 6, wherein said feed drive roller is driven by a unidirectional clutch drive coupled by a belt to a drive motor.

8. The printer-feeder according to claim 1, wherein said printer-feeder is mounted inside a tray that fits below the print engine and is physically coupled to the print engine by an interface connector.

9. The printer-feeder according to claim 5, including a tensioning roller operative to receive printable medium from said roll of printable medium and a sag sensor positioned proximate said printable medium prior to said tensioning roller operative to measure sag of said printable medium.

* * * * *